United States Patent [19]

Gerndt

[11] Patent Number: 4,480,772

[45] Date of Patent: Nov. 6, 1984

[54] SLEEVE MAKING METHOD AND APPARATUS

[75] Inventor: Robert J. Gerndt, Roswell, Ga.

[73] Assignee: Kimberly-Clark Corporation, Neenah, Wis.

[21] Appl. No.: 463,783

[22] Filed: Feb. 4, 1983

[51] Int. Cl.[3] ..... A41H 43/02

[52] U.S. Cl. ..... 223/1; 2/243 R; 223/2

[58] Field of Search ..... 223/1, 2; 2/243 R, 114

[56] References Cited

U.S. PATENT DOCUMENTS

| | | | |
|---|---|---|---|
| Re. 28,465 | 7/1975 | Reidy | 223/1 |
| Re. 30,520 | 2/1981 | Pierron | 2/243 R |
| 3,415,428 | 12/1968 | Mishkin | 223/1 |
| 3,681,785 | 8/1972 | Truman | 2/243 R |
| 3,696,445 | 10/1972 | Craig | 2/114 |
| 4,381,068 | 4/1983 | Raisin | 223/2 |

*Primary Examiner*—Louis Rimrodt
*Attorney, Agent, or Firm*—William D. Herrick; R. Jonathan Peters; Howard Olevsky

[57] ABSTRACT

An automated sleeve transfer apparatus and method adapted to receive continuous webs of material including pairs of left and right sleeves alternating between cuff-to-cuff and shoulder-to-shoulder relation and having a die cutting mechanism for receiving the pairs of sleeves from the webs is disclosed having a circular wheel having rotatable vacuum plates on its circumference for carrying pairs of sleeves along a circular path to a transfer point, a conveyor for transferring successive severed pairs of cuff-to-cuff sleeves from the die cutting mechanism to the vacuum plates on the circumference of the circular wheel, a mechanism within the circular wheel for rotating the vacuum plates to turn each sleeve end for end to rearrange the sleeves from cuff-to-cuff to shoulder-to-shoulder relation while moving along the circular path before said transfer point, a second conveyor for receiving successive severed pairs of shoulder-to-shoulder sleeves from the die cutting mechanism and for conveying the sleeves in spaced relationship along a linear path tangent to the circular path at said transfer point, and a control of the vacuum supplied to the vacuum plates so that successive rearranged pairs of sleeves are transferred as they arrive at the transfer point and are placed in the space between and overlapping successive sleeve pairs on the second conveyor moving along the path and with the cuffs of the sleeves in alignment.

13 Claims, 6 Drawing Figures

SLEEVE MAKING METHOD AND APPARATUS

Technical Field

This invention relates to the manufacture of garments from continuous webs and, more particularly, to an apparatus for the sleeve making section for an automated production line for the manufacture of garments from continuous webs.

Background Art

Heretofore it has been proposed to manufacture garments in series from webs and pre-manufactured sleeves on automated productions lines, a method and apparatus for such manufacture being illustrated in commonly assigned U.S. Pat. No. 3,681,785. Using this method and apparatus, or the method and apparatus of other prior patents, such as Pierron, U.S. Pat. No. Re. 30,520, and Craig, U.S. Pat. No. 3,696,445, pre-manufactured, individual sleeves are supplied to the production line and united with continuous moving webs from which the body panels of the garment are fashioned.

In addition to what is shown in such patents, methods are known and have been practiced commercially for making garments from continuous webs. Such commercial practice has involved sleeve making from continuous webs as a separate operation from the assembly of such sleeves with continuous webs to make the finished garments and also has involved attaching elastic to the cuffs of the sleeves as a separate operation using sewing machines with operators rather than on a continuous garment production line.

A method for garment manufacture which is adapted to be fully automated, including a section for sleeve making with elasticized cuffs, is disclosed in commonly assigned Patent Application Ser. No. 415,660 entitled "Method For Manufacturing Sleeved Garments". This method involves sleeve making from continuous webs and transferring and combining such sleeves with continuous moving webs adapted to form the body panels of the garments and also involves attaching elastic to the cuffs of the sleeves in-line with the sleeve manufacture.

Disclosure Of The Invention

The principal object of this invention is to provide an apparatus for the sleeve making section of an automated production line in which garment sleeves are arraned in lapped relation for application of cuff elastic.

A related object of this invention is to provide an apparatus for transferring sleeves severed from continuous webs of material and rearranging the sleeves so that all sleeves are similarly oriented for application of cuff elastic.

Another important object is to provide a method capable of being automated for transferring sleeves severed from continuous webs of material and rearranging the sleeves so that all sleeves are similarly oriented with the cuffs in alignment and fed continuously for application of cuff elastic.

Another object is to reduce the cost of manufacturing garment sleeves by eliminating waste of material through layout of the sleeves so that the patterns nest and providing a method by which the severed sleeves are rearranged from the nested configuration to a similar geometric orientation for further processing including application of cuff elastic.

Brief Description Of The Drawings

Further objects and advantages of the invention will become clear from the following description taken in conjunction with the accompanying drawings, in which.

Figure 1:
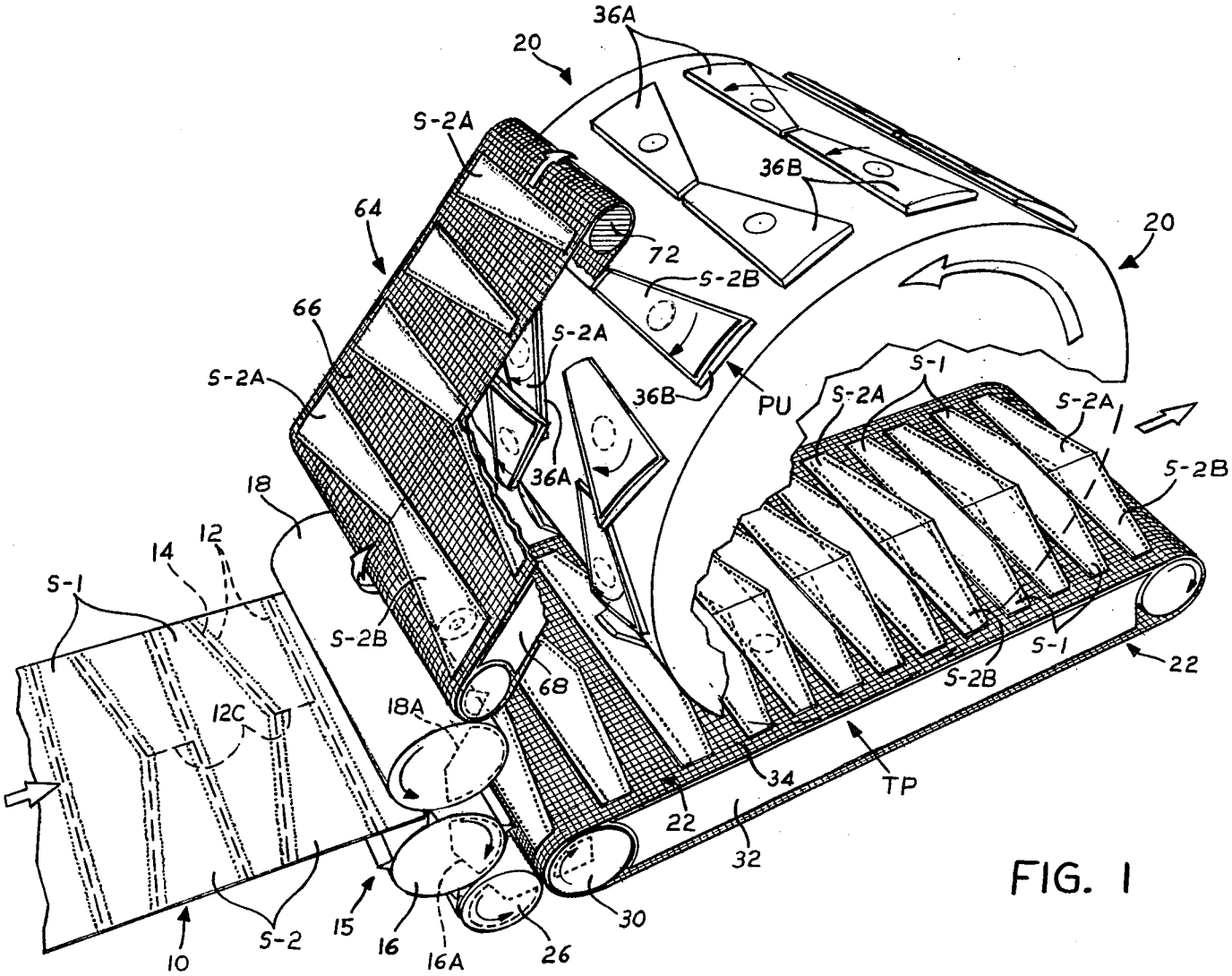
FIG. 1 is a fragmentary perspective schematic view of an apparatus embodying the invention including moving wires and a circular wheel for severing sleeve pairs from continuous webs provided to the apparatus and conveying, rearranging and delivering the sleeve pairs in overlapped arrangement, with all sleeve pairs similarly oriented with cuffs in alignment for application of cuff elastic.

Best Mode For Carrying Out The Invention:

Turning to FIG. 1, an apparatus is shown for use in the sleeve making section of an automated garment production line. The apparatus receives sleeve pairs S-1, S-2 provided in continuous webs 10 in a nested pattern in which sleeve pairs are alternating between cuff-to-cuff S-2 and shoulder-to-shoulder S-1 relation. After severing and rearranging the sleeve pairs S-1, S-2, the apparatus delivers them spaced, overlapped and conveyed continuously with all pairs in similar geometric relation shoulder-to-shoulder and with cuffs in alignment for application of cuff elastic as shown in the lower portion of FIG. 1 and in FIG. 6.

Figure 5:
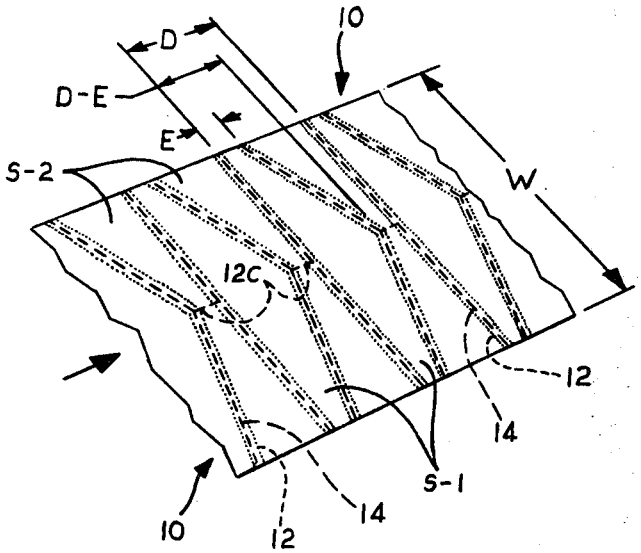
FIG. 5 is a view of the continuous webs provided to the apparatus of FIG. 1 which comprise webs of material including adhesive bands in a nested pattern adapted to form pairs of left and right sleeves.

To produce the sleeves, two superimposed webs 10 of garment material are attached along seams preferably formed by bands 12 of adhesive, although other seam forming methods may be used including such seam forming methods as ultrasonic bonding and sewing. It is preferred that the pairs S-1, S-2 of left and right sleeves provided to the apparatus, as shown in FIG. 5, are in a nested pattern in which they alternate between cuff-to-cuff and shoulder-to-shoulder relation in the webs 10 so that, on cutting along lines 14 that bisect the bands 12 of adhesive and extend longitudinally along the center line of the pairs, individual sleeves will be produced from the continuous webs without waste of sleeve material. It will be seen that sets of four sleeves (two left and right pairs) are preferably produced from a rectangular section of the two webs, having a width "W" and a length "D" with sleeve cuffs of width "E" and sleeve shoulders of width "D-E"; a preferred pattern of the sleeves has the cuffs taking up one-third and the shoulder two-thirds of the length "D"to (FIG. 5).

Various kinds of garment material may be used for sleeves, depending upon the end use of the garments in which the sleeves are assembled. Particularly useful materials are disclosed in U.S. Pat. No. 3,855,046 as nonwoven, pattern bonded polymeric webs.

As disclosed in copending, commonly assigned application Ser. No. 415,660, entitled "Method For Manufacturing Sleeved Garments", with sleeve pairs in parallel overlapped arrangement and cuffs sequentially in alignment, elastic bands may be fed under tension from rolls and attached to the cuffs by means such as adhesive. To facilitate the elastic application, it is desired that the sleeves be placed in a similar orientation and overlapped. The cuff elastic can then be attached to the top and/or bottom surfaces of the cuff as a continuous operation as the sleeve pairs are fed continuously past a cuff elastic application station.

Figure 6:
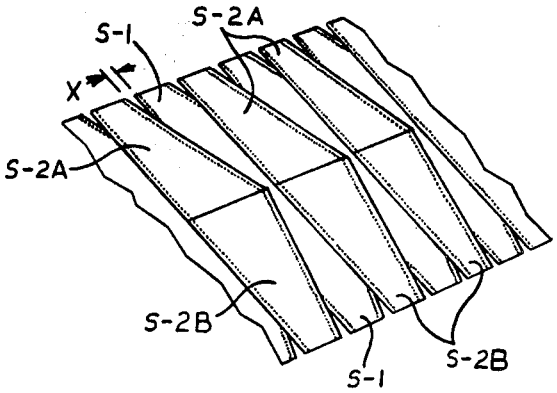
FIG. 6 is a view of overlapped sleeve pairs delivered by the apparatus.

Referring to FIGS. 1 and 5, it is preferred that the sleeve pairs S-1, S-2 be nested in the continuous webs 10 as formed and be rearranged to the arrangement shown in the lower right hand portion of FIG. 1 and in FIG. 6 in which the sleeve pairs S-2 are shoulder-to-shoulder instead of cuff-to-cuff as provided to the apparatus and the pairs of sleeves are overlapped and fed with the angled top edges of the sleeves S-1, S-2 leading as the sleeves are conveyed from the apparatus.

The method by which the sleeves are transferred from the incoming continuous webs of garment material to the delivery end of the apparatus involves feeding, directly through the apparatus without change of orientation, the sleeve pairs S-1 having a shoulder-to-shoulder relation in the incoming web 10 and rearranging the sleeve pairs S-2 having a cuff-to-cuff relation in the incoming web 10 so that they are delivered overlapped with and in a similar orientation to the other sleeve pairs S-1.

Before transferring the sleeves, the continuous webs 10 are cut to sever the pairs of sleeves by means herein shown as a rotary die cutting mechanism 15 in FIG. 1. The incoming continuous webs 10 are fed between die cutting rolls 16, 18, one roll 16 having projecting blades and the other roll 18 comprising the anvil roll of the rotary die cutting mechanism 15. It is preferred that the cutting pattern should bisect the bands 12 of adhesive transversely joining the superposed webs in order to produce the sleeves without material waste. It is also necessary to cut the webs longitudinally along the center line of those sleeve pairs only that are joined cuff-to-cuff, as indicated by the dashed lines 12C.

Figure 3:
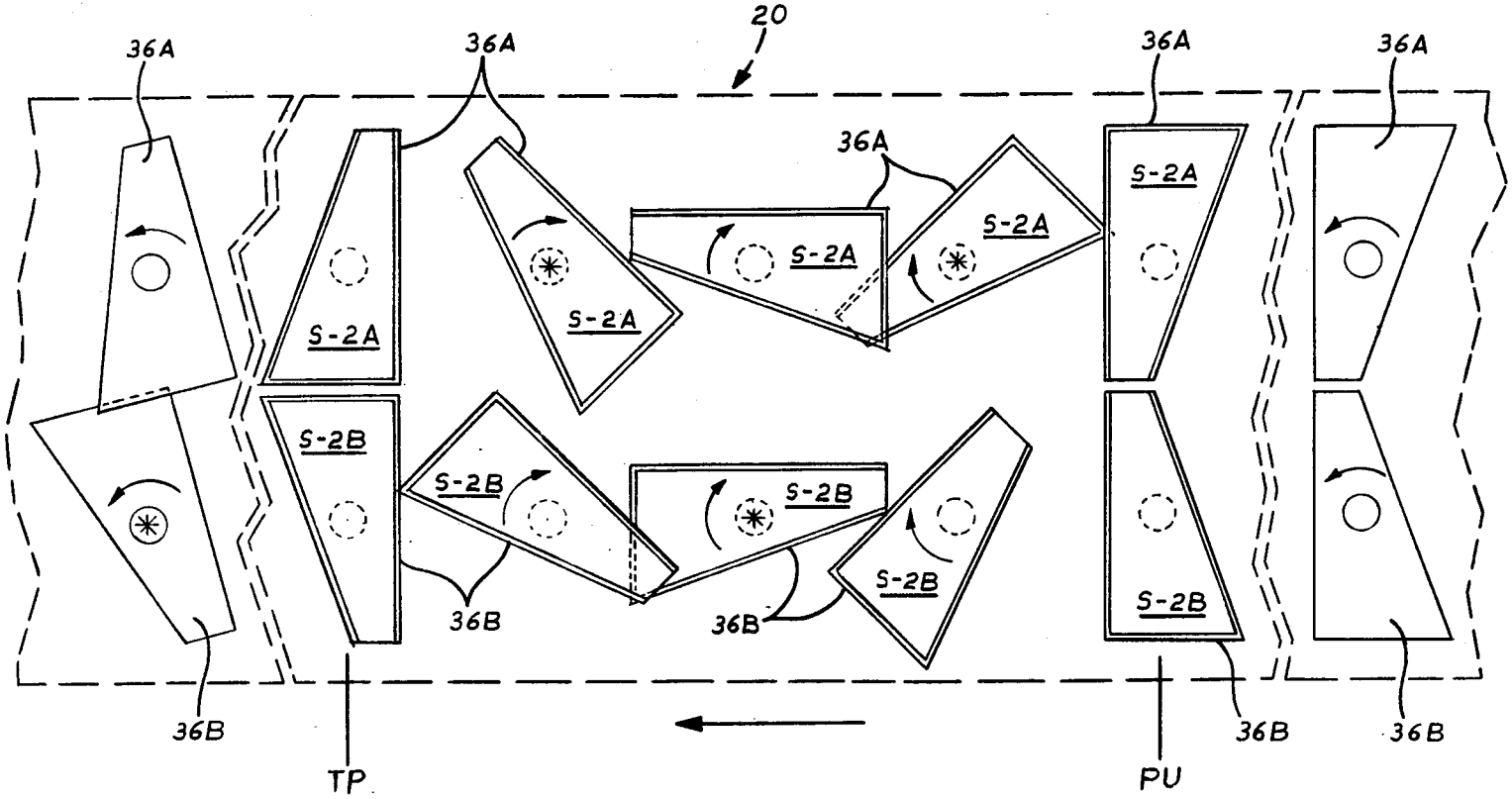
FIG. 3 is a schematic view illustrating the rotational movement of the vacuum plates to rearrange the sleeves as the wheel revolves.

In carrying out this invention, successive severed cuff-to-cuff sleeve pairs S-2 are separated from the webs 10 and carried along a circular path defined by the periphery of a wheel 20 to a transfer point TP. Each sleeve S-2A, S-2B of the pairs S-2 is turned end for end, as shown in FIGS. 1 and 3, to rearrange the sleeves from cuff-to-cuff to shoulder-to-shoulder relation while moving along the circular path before the transfer point TP. In this manner, the sleeves S-2A, S-2B which are arranged cuff-to-cuff as delivered are rearranged to the shoulder-to-shoulder relation of the other sleeve pairs S-1. The successive severed pairs of shoulder-to-shoulder sleeves are conveyed in spaced relationship from the cutting rollers 16, 18 along a linear path defined by the conveyor 22 which is tangent to the circular path at the transfer point TP. The successive rearranged pairs S-2 of sleeves moving along the circular path are transferred, as they arrive at the transfer point TP, to the linear path and placed in the open space between and overlapping the other sleeve pairs S-1.

In this manner, all sleeves are brought into similar geometric relation with the cuffs in alignment. As shown in FIG. 6, the successive cuffs are spaced by the distance X, which is the distance d/2-e for equally spaced sleeve pairs produced with all machine speeds being equal and transfers carried out in the preferred way with no relative speed differentials between the delivery and receiving components. When elastic is applied, the elastic bands may be cut in these spaces X, which can be lengthened or shortened by controlling the relative speed differentials and phasing of such apparatus components.

A preferred apparatus for conveying and rearranging the sleeves is illustrated in FIG. 1. The die cutting rolls 16, 18 preferably have a circumference equal to two or more multiples of the distance D. stationary vacuum baffles inside the rolls 16, 18 provide chambers 16A, 18A connected to a vacuum source. With vacuum holes provided only on that surface of roll 18 which corresponds to (or contacts with) sleeve pair S-2 and, similarly, with vacuum holes provided only on that surface of roll 16 which corresponds to (or contacts with) sleeve pair S-1, every other sleeve pair is transferred with each roll. Thus, the sleeve pairs S-1 are retained on the cutting roll 16, carried to a vacuum transfer roll 26, and transferred to the conveyor 22. The sleeve pairs S-2 are retained on the anvil roll 18 and transferred to the wheel 20. The conveyor 22 has a suction roll 30 and a suction box 32 under the wire 34 to hold the sleeve pairs S-1 on the wire as the wire moves to convey the sleeve pairs S-1 along a linear path. The linear path is tangent at a transfer point TP to the circular path defined by the periphery of the wheel 20 which is used to carry the rearranged sleeves S-2A S-2B to the transfer point TP for transfer to the wire 34 in overlapping relation with the sleeve pairs S-1 already on the wire.

Figure 4:
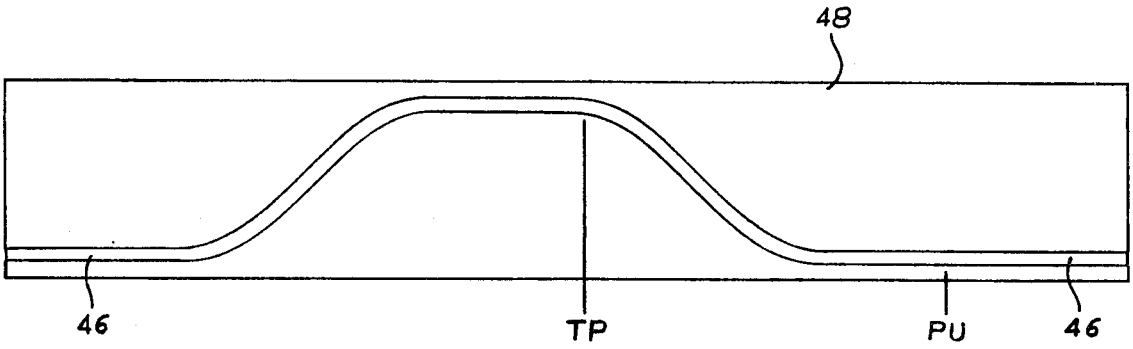
FIG. 4 is a layout of a cam track for a cam for controlling the rotational movement of the vacuum plates.

In keeping with the invention, the circular wheel 20 has a plurality of pairs of rotatable vacuum plates 36A, 36B spaced around its circumference for carrying sleeves S-2A, S-2B to the transfer point TP. Means are provided within the wheel 20 for rotating the vacuum plates 36A, 36B to turn each sleeve S-2A, S-2B end for end to rearrange the sleeves from cuff-to-cuff to shoulder-to-shoulder relation while moving along the circular path defined by the periphery of the wheel 20. The rotation of the vacuum plates 36A, 36B is shown in FIG. 3, which illustrates successive stages of rotation of one pair of vacuum plates 36A, 36B to rearrange sleeves S-2A, S-2B end for end and the beginning of the return rotation of the plates 36A, 36B after the transfer point TP when sleeves have been transferred to the wire 34. In the present case, referring to FIG. 2, the vacuum plates 36A, 36B are rotatably mounted on spindles 38A, 38B supported in fixed bearings 40A, 40B and are rotatable by a rack 41 having sections 41A, 41B which engage with pinion gears 42A, 42B rotatable with the spindles 38A, 38B. The rack 41 is moved by a cam follower 44 which rides in a track 46 on the edge of a fixed cam 48. As the wheel 20 rotates, the cam follower 44 rides in the track 46, causing the rack 41 to shift in one direction and then return, to rotate the vacuum plates 36A, 36B end for end (180 degrees) and then return to the original position. A schematic layout of the track 46 on the periphery of the fixed cam 48 is shown in FIG. 4, which illustrates that, referring also to FIG. 3, between the pick-up point PU and the transfer point TP, reading both Figures from right to left, the plates 36A, 36B are caused to rotate end for end. Referring also to FIG. 1, this rotation of the plates occurs as the wheel 20 turns counterclockwise from a position just ahead of the pick-up point PU to position TP which is the transfer point where the sleeves are transfered to the horizontal wire. Still referring to FIGS. 3 and 4, following transfer of the sleeves to the horizontal wire 34, the vacuum plates 36A, 36B are rotated by the rack 41 and pinion gears 42A, 42B in the return direction to bring them to the original configuration of the pick-up point PU for receiving sleeves.

Figure 2:
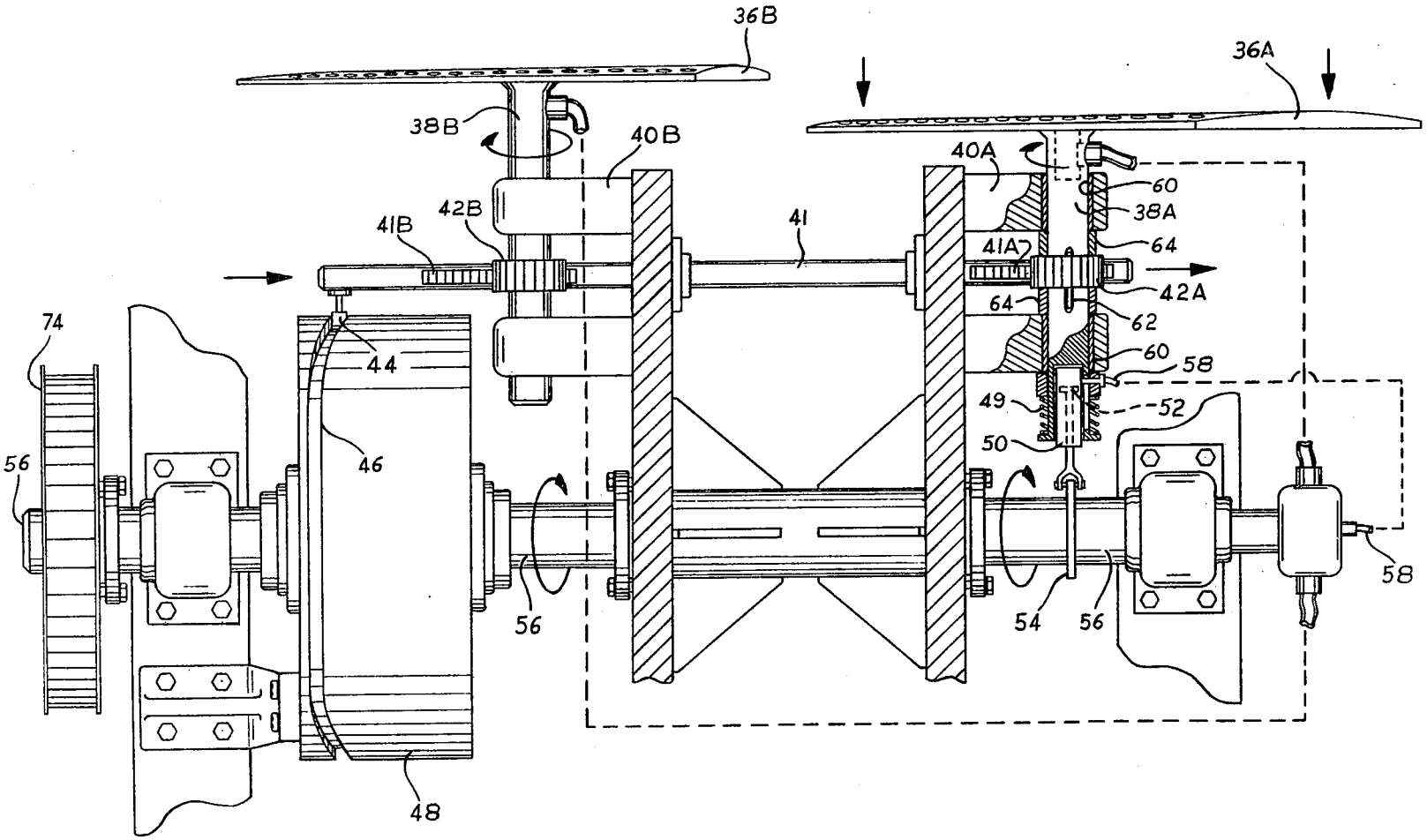
FIG. 2 is a fragmentary elevational view with parts shown in section of a mechanism within the wheel for operating rotatable vacuum plates on its circumference for carrying the sleeves along a circular path and rearranging the sleeves.

In order to avoid interference between adjacent vacuum plates as they rotate, one of the vacuum plates of each pair is not only mounted for rotation but also for retraction radially relative to the wheel 20 sufficiently to provide clearance between vacuum plates as they are rotated. In FIG. 2 the right hand plate 36A is shown mounted for retraction; the same construction is employed for mounting the left hand plate 36B in both circumferentially spaced pairs, and the retractable plate is alternately the left and then the right plate so that adjacent plates will be in different planes as they are rotated to avoid interfering. As shown in FIG. 2, the right hand plate 36A as viewed in that Figure, is retracted radially inwardly to provide the requisite clearance by means of a spring 49 before it is rotated. To return the plate 36A radially outwardly, an air cylinder 50 is provided in the end of the spindle 38A and a fixed piston 52 held by a ring 54 on the drive shaft 56. Air supplied under pressure to the end of the piston 52 through an air line 58 shown schematically causes the spindle 38A to move radially outwardly against the force of the spring 49 to a position side-by-side with the other plate 36B. In this outward position, the two plates 36A, 36B are located to receive sleeves from the continuous web 10 at the pick-up point PU or to deliver sleeves at the transfer point TP to the horizontal wire 34. The radial movement of the plates is caused to occur between the pick-up point PU and the transfer point TP by valves in the air lines 58 to each cylinder 50; similarly these valves are operated during the return rotation of the plates as they are rotated by the wheel 20 following the transfer point TP. Thus, one plate of every pair is moved radially inwardly so that it is clear of the other plate of the pair and the circumferentially spaced plates while they are rotated for rearranging the sleeves or for returning the plates to their original position. To permit radial movement of one vacuum plate of each pair, the spindle 38A (FIG. 2) is supported within linear bushings 60; the gear 42A has a sliding fit with a key 62 on the spindle 38A and gear spacers 64 retain the gear 42A in position to engage with the rack section 41A. The same construction is provided for the vacuum plate 36B where it is mounted for retraction.

In order to transfer the sleeve pairs S-2 in cuff-to-cuff relation from the die cutting mechanism 15 to the wheel 20, a second conveyor 64 is provided, herein shown as an upper inclined moving wire 66 and suction box 68. As shown in FIG. 1, the sleeves of the cuff-to-cuff pairs S-2 are retained on the anvil roll 18 which has a suction chamber 18A for this purpose and are transferred to the upper wire 66. The upper wire 66 takes every other sleeve pair S-2 and transfers them to the successive vacuum plates 36A, 36B on the periphery of the wheel 20. The sleeve pairs S-2 traveling to the upper wire must be severed into individual sleeves S-2A, S-B before they reach the wire as shown in FIG. 1. In order that these cuff-to-cuff sleeves S-2A, S-2B are properly oriented for the vacuum plates 36A, 36B and moving in the same direction as the periphery of the wheel 20, they are conveyed along the top surface of the upper inclined wire 66 and transferred after being carried around the upper support roll 72 for the wire 66. The surface speed of the upper wire 66 is synchronized with the speed of the die cutting rolls 16, 18 and the wheel 20 so that the sleeves are placed exactly on the vacuum plates 36A, 36B. Properly chosen sleeve travel distances from the die cutting mechanism 15 to the transfer point PU along the upper and lower conveyor routes, in conjunction with proper selection of the pivot point of the vacuum plates 36A, 36B, will allow the sleeve pairs S-1 and S-2, as finally placed on the conveyor, to be equally spaced when all apparatus speeds are synchronzied and phased correctly.

Also, the supply of vacuum from a source to the vacuum plates through lines (not shown) is controlled to facilitate pick-up from the upper wire 66 and transfer to the lower wire 34. The air lines to the air cylinders 50 also include valves (not shown) to admit air under pressure to the air cylinders 50 in timed relation to cause the plates to move inwardly and outwardly to avoid interference as they are revolved by the wheel 20 and rotated by the cam 48.

Power for revolving the wheel 20 may be transmitted through a gear 74 or similar transmission means. For operating the die cutting mechanism 15 and the conveyors 22 and 64, conventional transmissions may be provided as well as connections from a vacuum source to the suction boxes. By including variable transmissions for the apparatus components so that their relative speed may be varied as well as the absolute speed, means will be provided for controlling the production rate of the apparatus as well as the spacing X between sleeve pairs carried from the appratus on the conveyor 22.

I claim:

1. In a method for manufacturing garment sleeves from continuous webs of material, the steps of:

providing continuous webs of material including seams forming pairs of left and right sleeves in a pattern alternating between cuff-to-cuff and shoulder-to-shoulder relation in said webs;

cutting said continuous webs to sever said pairs of sleeves;

separating successive severed pairs of cuff-to-cuff sleeves from said webs and turning each sleeve end for end to rearrange said cuff-to-cuff pairs of sleeves into shoulder-to-shoulder relation;

separating successive shoulder-to-shoulder pairs of sleeves from said webs and conveying said separated shoulder-to-shoulder pairs of sleeves in spaced relationship; and transferring successive rearranged pairs of sleeves and placing each transferred pair in the space between and overlapping successive shoulder-to-shoulder pairs with the cuffs of the sleeves in alignment.

2. A method according to claim 1 in which said left and right sleeve pairs are nested in said pattern.

3. A method according to claim 1 in which said severed pairs of cuff-to-cuff sleeves are turned end for end while carried along a circular path.

4. In a method for manufacturing garment sleeves from continuous webs of material, the steps of:

providing continuous webs of material including seams forming pairs of left and right sleeves in a pattern alternating between cuff-to-cuff and shoulder-to-shoulder relation in said webs;

cutting said continuous webs to sever said pairs of sleeves;

separating successive severed pairs of cuff-to-cuff sleeves from said webs and carrying said separated pairs of sleeves along a circular path to a transfer point;

turning each sleeve end for end to rearrange the sleeves from cuff-to-cuff to shoulder-to-shoulder relation while moving along said circular path before said transfer point;

separating successive pairs of shoulder-to-shoulder sleeves from said webs and conveying said separated pairs of sleeves in spaced relationship along a linear path tangent to said circular path at said transfer point; and transferring successive rearranged pairs of sleeves as they arrive at said transfer point from said circular path to said linear path and placing each transferred pair in the space between and overlapping successive sleeve pairs moving along said linear path and with the cuffs of the sleeves in alignment.

5. A method according to claim 4 in which one of said cuff-to-cuff sleeves is moved radially relative to said circular path before turned end for end to avoid interference with the other turning sleeve.

6. A method according to claim 4 in which moving screens and vacuum boxes are used for transferring separated sleeves after cutting from said webs to said circular path and along said linear path.

7. A method according to claim 4 in which rotatable vacuum plates are used for carrying said sleeves along said circular path and for turning said sleeves end for end.

8. An automated sleeve transfer apparatus adapted to receive continuous webs of material including seams forming pairs of left and right sleeves in a pattern alternating between cuff-to-cuff and shoulder-to-shoulder relation in said webs, the combination comprising:

cutting means for receiving said webs and severing said pairs of sleeves;

endless means having rotatable vacuum plates for carrying pairs of sleeves along a first path to a transfer point;

a conveyor for transferring successive severed pairs of cuff-to-cuff sleeves from said cutting means to said vacuum plates on said endless means;

means for rotating said vacuum plates to turn each sleeve carried thereby end for end to rearrange the sleeves from cuff-to-cuff to shoulder-to-shoulder relation while moving along said first path before said transfer point;

a second conveyor for receiving successive severed pairs of shoulder-to-shoulder sleeves from said cutting means and for conveying said sleeves in spaced relationship along a second path adjacent said first path at said transfer point; and means for transferring successive rearranged pairs of sleeves from said vacuum plates as said sleeves arrive at said transfer point and placing each transferred pair in the space between and overlapping successive sleeve pairs on said second conveyor moving along said second path and with the cuffs of the sleeves in alignment.

9. In an automated sleeve transfer apparatus adapted to receive continuous webs of material including seams forming pairs of left and right sleeves in a pattern alternating between cuff-to-cuff and shoulder-to-shoulder relation in said webs, the combination comprising:

cutting means for receiving said webs and severing said pairs of sleeves;

a circular wheel having rotatable vacuum plates on its circumference for carrying pairs of sleeves along a circular path to a transfer point;

a conveyor for transferring successive severed pairs to cuff-to-cuff sleeves from said means to said vacuum plates on the circumference of said circular wheel;

means within said circular wheel for rotating said vacuum plates to turn each sleeve carried thereby end for end to rearrange the sleeves from cuff-to-cuff to shoulder-to-shoulder relation while moving along said circular path before said transfer point;

a second conveyor for receiving successive severed pairs of shoulder-to-shoulder sleeves from said cutting means and for conveying said sleeves in spaced relationship along a linear path tangent to said circular path at said transfer point; and means for transferring successive rearranged pairs of sleeves from said vacuum plates as said sleeves arrive at said transfer point and placing each transferred pair in the space between and overlapping successive sleeve pairs on said second conveyor moving along said linear path and with the cuffs of the sleeves in alignment.

10. An apparatus according to claim 9 in which said cutting means comprises a rotary die cutting mechanism.

11. An apparatus according to claim 9 in which the differential between the circumferential speed of said wheel and the speed of said second receiving conveyor is variable to vary the spacing between the lapped sleeve pairs on said second conveyor.

12. An apparatus according to claim 9 in which the differential between the circumferential speed of said wheel and the speed of said second receiving conveyor is zero to maintain a predetermined spacing between the lapped sleeve pairs on said second conveyor.

13. In an apparatus adapted to receive continuous webs of material including seams forming pairs of left and right sleeves in a pattern alternating between cuff-to-cuff and shoulder-to-shoulder relation in said webs, the combination comprising:

means for cutting said continuous webs to sever said pairs of sleeves;

means for separating successive severed pairs of cuff-to-cuff sleeves from said webs and for turning each sleeve end for end to rearrange said cuff-to-cuff pairs of sleeves into shoulder-to-shoulder relation;

means for separating successive shoulder-to-shoulder pairs of sleeves from said webs and conveying said separated shoulder-to-shoulder pairs of sleeves in spaced relationship; and means for transferring successive rearranged pairs of sleeves and placing each transferred pair in the space between and overlapping successive shoulder-to-shoulder pairs with the cuffs of the sleeves in alignment.

* * * * *